US005931473A

United States Patent [19]

Suit

[11] Patent Number: 5,931,473

[45] Date of Patent: Aug. 3, 1999

[54] SET OF FLATWARE FOR STIMULATING CONVERSATION OR INSPIRATIONAL THOUGHT

[75] Inventor: Anne R. Suit, Wytheville, Va.

[73] Assignee: Design/Design International, Inc., Wytheville, Va.

[21] Appl. No.: 09/023,727

[22] Filed: Feb. 13, 1997

[51] Int. Cl.[6] ..... A63F 9/00

[52] U.S. Cl. ..... 273/459; D7/645; 40/299

[58] Field of Search ..... 273/429, 430, 273/431, 432, 459; 40/324, 299; D7/642, 645

[56] References Cited

U.S. PATENT DOCUMENTS 3,891,209 6/1975 Kritzberg ..... 273/459

OTHER PUBLICATIONS

Oneida Advertisement, Gourmet Magazine, Oct. 1974, p. 61.

*Primary Examiner*—William H. Grieb

*Attorney, Agent, or Firm*—Kennedy Covington Lobdell & Hickman, LLP

[57] ABSTRACT

A set of flatware including a plurality of flatware pieces of a plurality of utensil types, with each flatware piece having formed thereon a word selected from a group of predetermined words. The flatware pieces are sufficient in number to form a predetermined number of place settings at which the flatware pieces within each utensil type are randomly distributed for forming random combinations of the selected words at each of the place settings. The words of the group may be selected to foster conversation among the users of the set of flatware.

10 Claims, 5 Drawing Sheets

SET OF FLATWARE FOR STIMULATING CONVERSATION OR INSPIRATIONAL THOUGHT

BACKGROUND OF THE INVENTION

The present invention relates generally to sets of flatware, and more particularly to a novel set of flatware which stimulates conversation and promotes inspirational thought.

It is well known that pleasant conversation among a group of people can provide an uplifting and highly enjoyable experience for the participants. Many such conversations have been enjoyed by groups of people gathered together for a meal at a party, family gathering, or other festive occasion. The unique feeling of fellowship and intellectual stimulation provided by engaging conversation at such gatherings is highly prized by those who have experienced it, but does not always arise whenever such a gathering takes place. It can be difficult to promote conversation when day to day concerns and other routine issues impede the development of the inspired state of mind which leads to highly enjoyable discourse.

A need therefore exists for an arrangement which can stimulate conversation among a group of people gathered for a meal and for an arrangement which can foster engaging and inspirational conversation at such meals.

SUMMARY OF THE INVENTION

It is accordingly an object of the present invention to provide a set of flatware for a group of people which can foster conversation among the group, and which can also foster inspirational thought by the individuals making up the group.

It is a further object of the present invention to provide a word game for play by participants gathered for a meal, and to provide a method of playing such a word game.

Briefly summarized, the present invention accomplishes these objectives by providing a set of flatware comprising a plurality of flatware pieces of a plurality of utensil types, with each of the flatware pieces having formed thereon a word selected from a group of predetermined words. The flatware pieces are sufficient in number to form a predetermined number of place settings at which the flatware pieces within each of the utensil types are randomly distributed for forming the random combinations of the selected words at each of the place settings.

Preferably, each of the words of the group is selected to foster conversation among the users of the set of flatware, and each of the words of the group may preferably be selected to foster inspirational thought by the users. It is advantageous if the utensil types include salad forks, dinner forks, teaspoons, tablespoons, and dinner knives.

In accordance with another aspect of the invention, a word game for play by a plurality of participants is provided, and includes a predetermined number of place setting locations and a set of flatware pieces of a plurality of utensil types, each of the pieces having formed thereon a word selected from a predetermined group of words. The set of flatware pieces is sufficient to form a place setting at each of the place setting locations with the pieces within each utensil type being distributed so as to generate random combinations of the selected words at each place setting, whereby each participant can read the combination of words at the respective place setting of the participant, and the participants can compare the combination of words at each of the place settings with the combination of words at the other place settings.

In accordance with a further aspect of the invention, a method of playing a word game among a plurality of participants is provided, and includes the steps of providing a set of flatware pieces of a plurality of utensil types, each of the flatware pieces having formed thereon a word selected from a group of predetermined words, and distributing the flatware pieces to form a plurality of place settings at which the pieces within each of the utensil types are randomly mixed, so as to generate random combinations of the selected words at each place setting. The method of playing the word game further includes each participant reading the random combinations of words at a respective one of the place settings and continuing play by the participants comparing the random combination of words at each place setting with the combinations of words at the other place settings.

The invention will be described in further detail below in terms of an exemplary embodiment of a set of flatware.

DESCRIPTION OF THE PREFERRED EMBODIMENT

Figure 1:
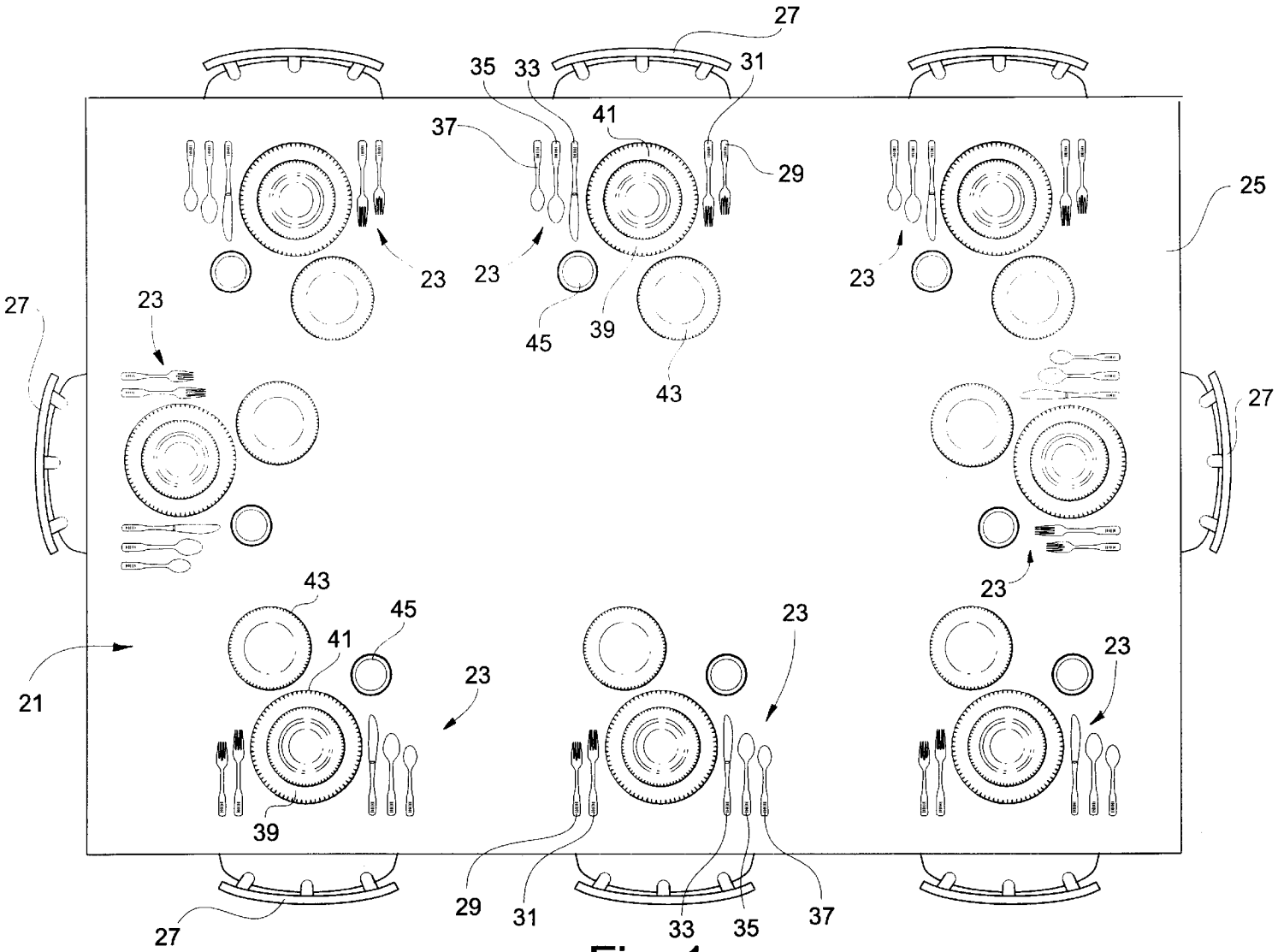
FIG. 1 is a plan view of a dining table with the set of flatware of the present invention arranged thereon.

Referring now to the accompanying drawings, FIG. 1 shows a set of flatware 21 of the present invention distributed at a number of place settings 23 on a dinning surface 25 in the form of a dining table. A chair 27 has been provided at each of the place settings 23 for the seating of a person during the meal and during conversation to be generated by the set of flatware 21, which includes flatware pieces of various utensil types including salad forks 29, dinner forks 31, dinner knives 33, tablespoons 35, and teaspoons 37. Each of the place settings 23 have also been provided with a dinner plate 39, a soup bowl 41 placed on top of the dinner plate 39, a bread plate 43, and a glass 45, which do not form part of the present invention but are shown to illustrate the dining table as set for a meal.

Figure 2:
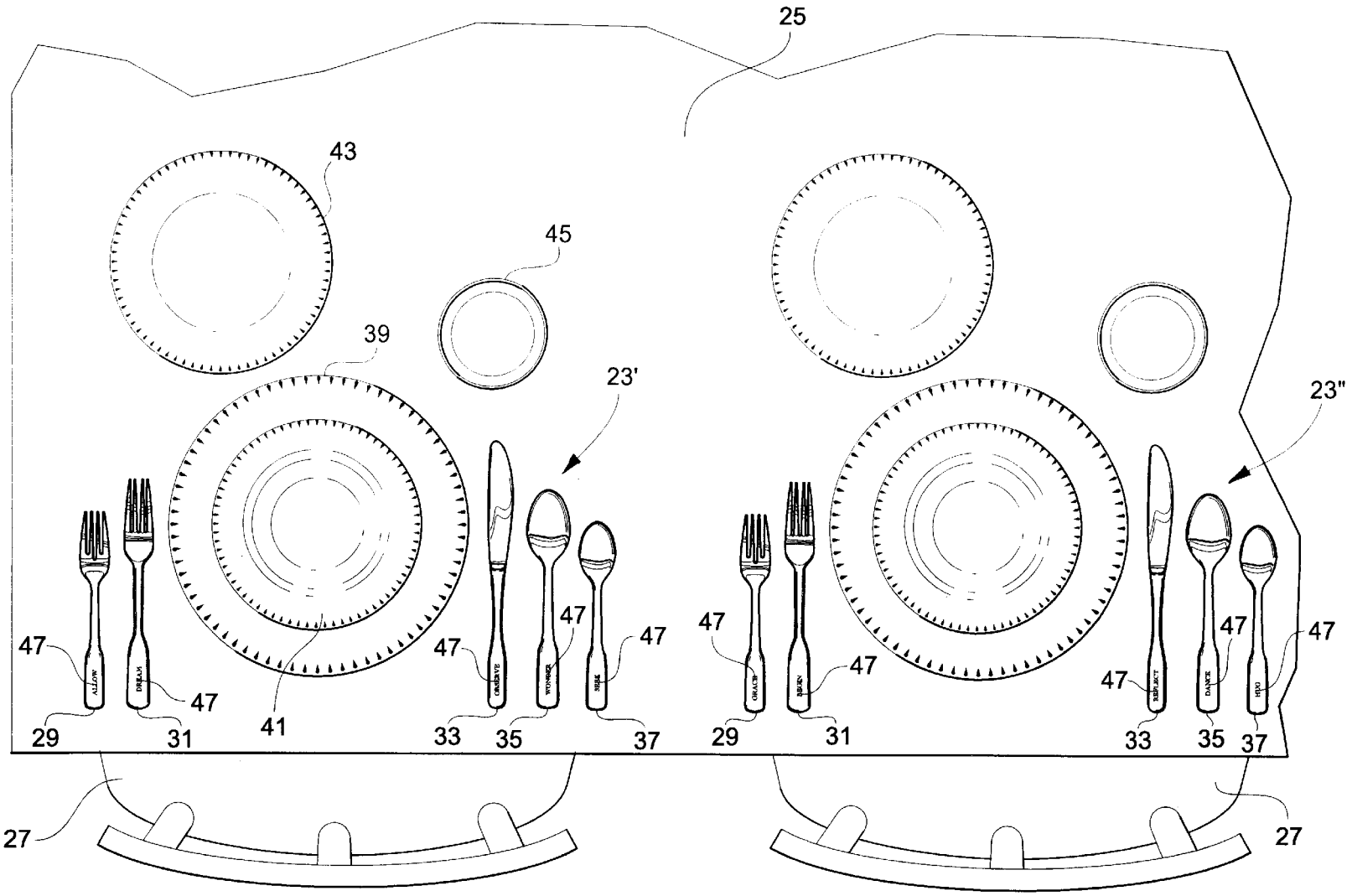
FIG. 2 is a detail view of FIG. 1 showing two place settings with the flatware pieces of the present invention.

In FIG. 2, place settings 23' and 23" can be seen in detail. Each of the pieces of the set of flatware 21 of the present invention has formed thereon a word 47 from a group of predetermined words selected to foster conversation among the users of the set of flatware 21, and to foster inspirational thought by each of those individual users. Accordingly, at the place setting 23' the salad fork 29 has formed thereon the word ALLOW, the dinner fork 31 has formed thereon DREAM, the dinner knife 33 has formed thereon OBSERVE, the tablespoon 35 has formed thereon WONDER, and the teaspoon 37 has formed thereon SEEK. At the place setting 23", the pieces of the set of flatware 21 placed thereat bear the words 47 GRACE, BEGAN, REFLECT, DANCE, and HUG. Preferably, the flatware pieces within each of the types of utensils, i.e., salad forks 29, dinner forks 31, dinner knives 33 etc., are randomly distributed among the place settings 23, so as to create random, unexpected, and surprising combinations of the words 47 at each of the place settings 23. It can be seen from the illustrated place settings 23', 23" that the pieces of the set of flatware 21, when distributed among the place settings in accordance with the present invention, provide combinations of words 47 which will provoke and inspire conversation and uplifting thought among a group of persons dining together and enjoying stimulating discourse.

Figure 3:
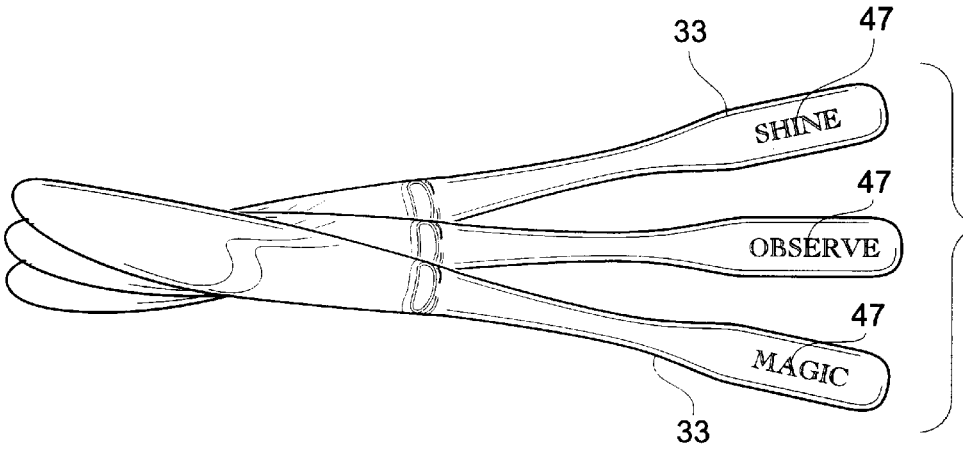
FIG. 3 is a plan view of three dinner knives of the present invention.
Figure 4:
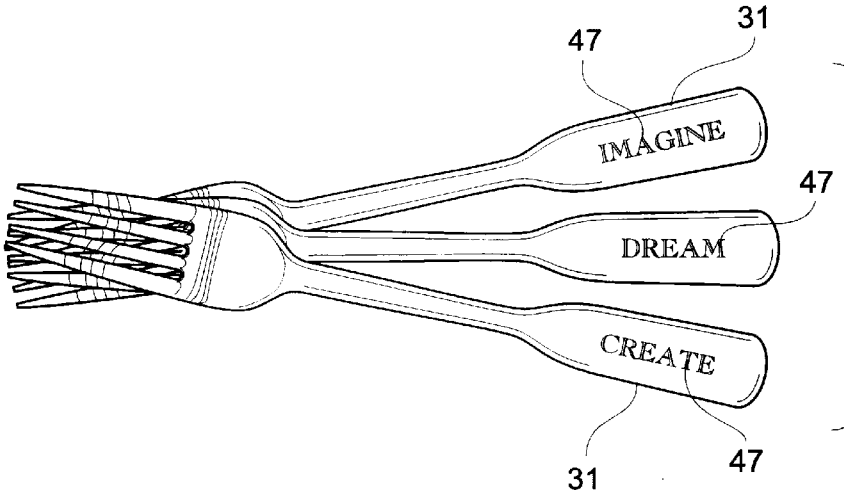
FIG. 4 is a plan view of three dinner forks of the present invention.
Figure 5:
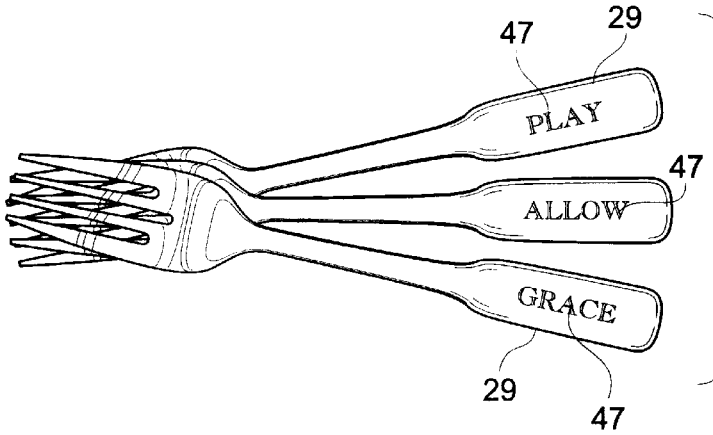
FIG. 5 is a plan view of three salad forks of the present invention.

A group of dinner knives 33 in accordance with the present invention is shown in FIG. 3, each of which has formed thereon a word 47 selected from the groups SHINE, OBSERVE, and MAGIC. FIG. 4 illustrates a group of dinner forks 31 of the present invention, each of the dinner forks 31 having formed thereon a word 47 selected from the group IMAGE, DREAM, and CREATE. FIG. 5 shows a group of salad forks 29 of the present invention, each of which has formed thereon a word 47 selected from the group PLAY, ALLOW, and GRACE.

Figure 6:
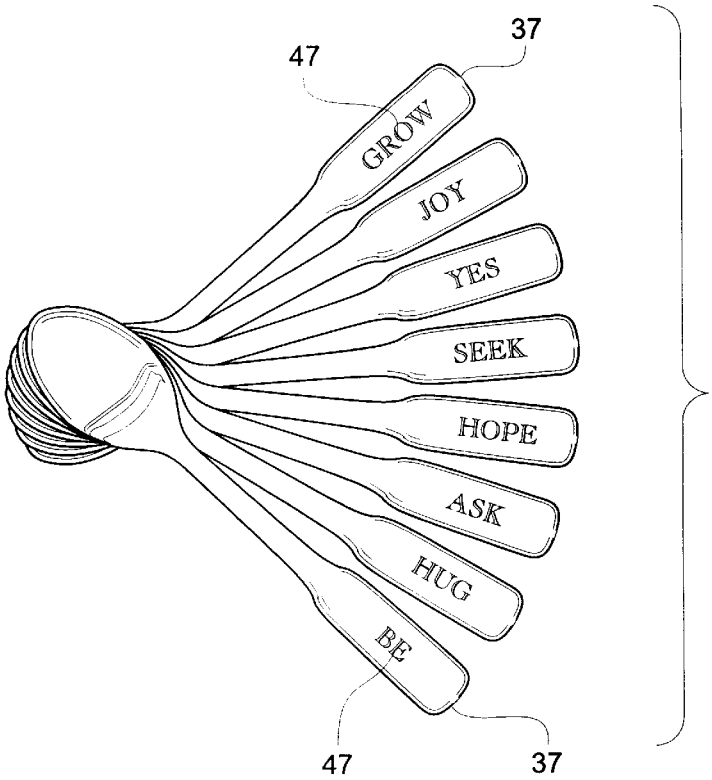
FIG. 6 is a plan view of eight teaspoons of the present invention.
Figure 7:
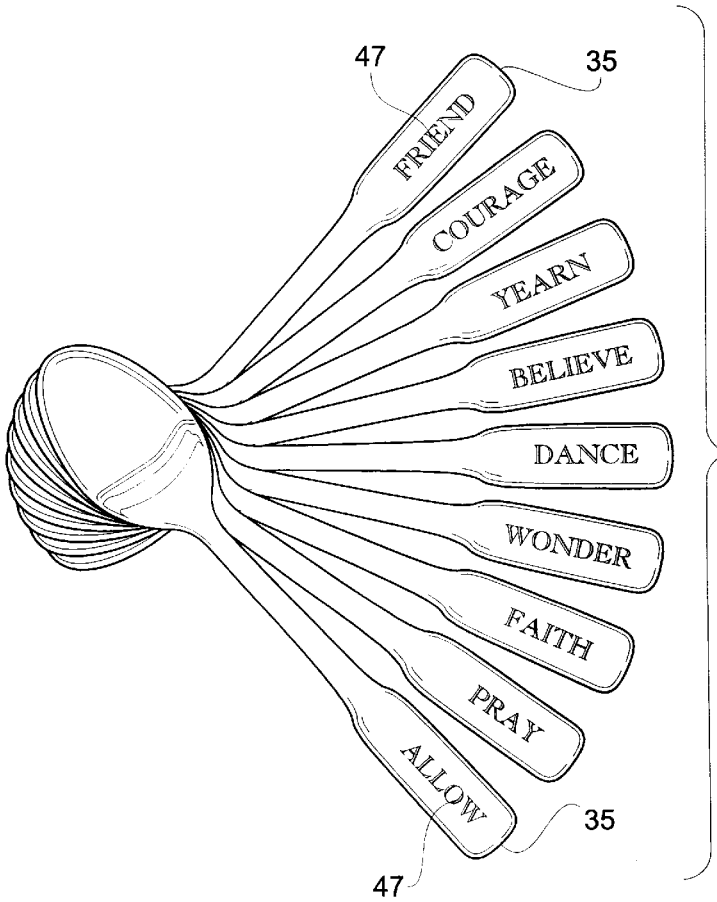
FIG. 7 is a plan view of nine tablespoons of the present invention.

A group of dinner spoons 35 of the present invention is shown in FIG. 6, with each of the tablespoons 35 having formed thereon a word 47 selected from the group GROW, JOY, YES, SEEK, HOPE, ASK, HUG, and BE. In FIG. 7 a group of tablespoons 35 of the present invention are shown, each of which bear a word 47 from the group FRIEND, COURAGE, YEARN, BELIEVE, DANCE, WONDER, FAITH, PRAY, ALLOW.

Figure 8:
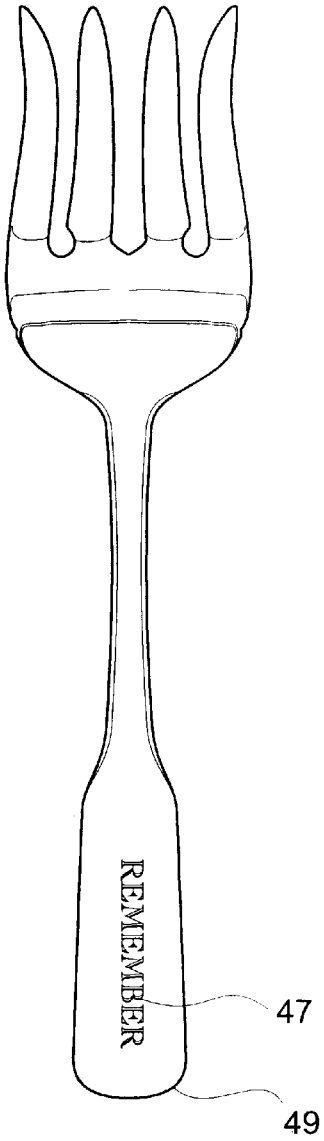
FIG. 8 is a plan view of a serving fork of the present invention.
Figure 9:
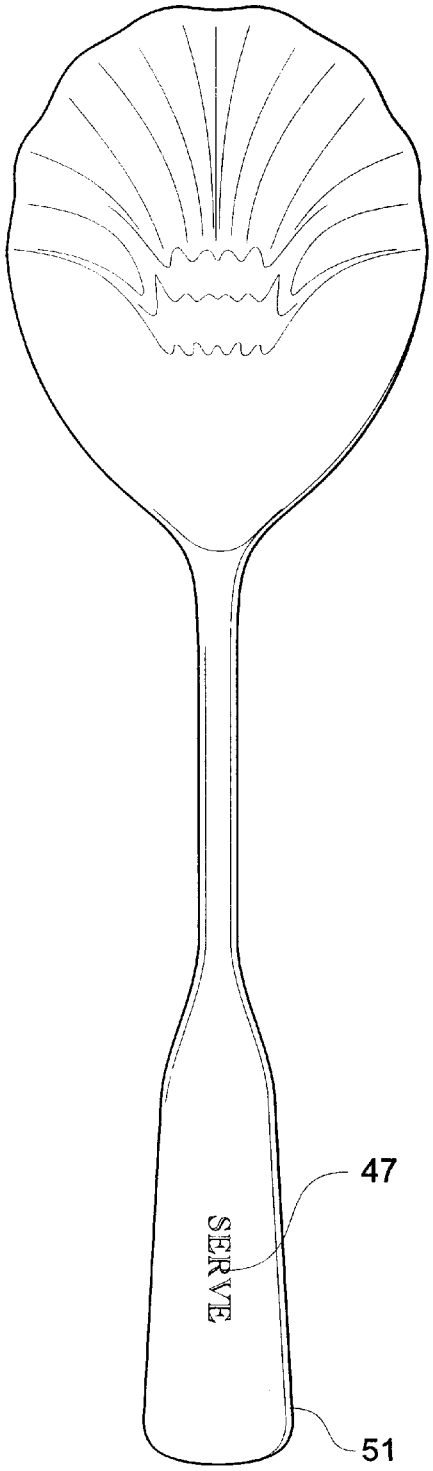
FIG. 9 is a plan view of a serving spoon of the present invention.
Figure 10:
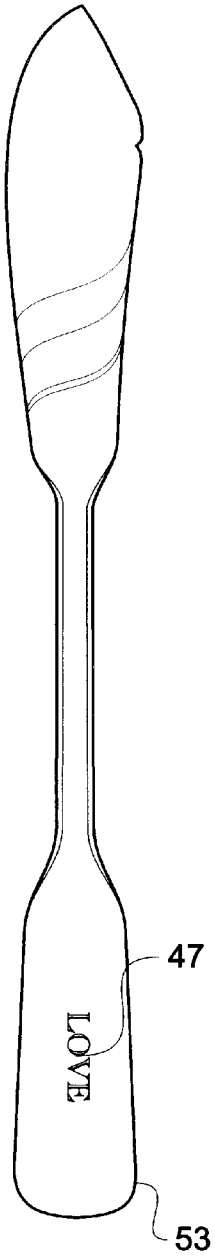
FIG. 10 is a plan view of a butter knife of the present invention.

The set of flatware pieces 21 of the present invention may include serving pieces as well, including, as shown in FIG. 8, a serving fork 49, here bearing the word 47 REMEMBER. Additionally, serving pieces such as the serving spoon 51 having the word 47 SERVE formed thereon and shown in FIG. 9, and other flatware pieces such as a butter knife 53 as shown in FIG. 10, and here bearing the word 47 LOVE, can be advantageously included in the set of flatware 21 of the present invention. It will be understood that the scope of the present invention includes other serving pieces and types of utensils, such as various forks, knives, spoons, tongs, and other implements which have appropriate words 47 formed thereon for distribution and accordance with the principles of the present invention.

Any words or letter combinations, whether in correct "dictionary" form or not, may be used for the words 47 of the present invention. The group of words 47 may be selected from any type of words, including those having common characteristics such as spirituality, fellowship, humor, brashness, or any other characteristic, or the words 47 may be completely unrelated to each other to create unforeseen combinations.

Moreover, it will also be understood that the words 47 formed on the pieces of the set of flatware 21 are not limited to those specifically illustrated herein, but include other suitable words for fostering conversation and inspirational thought. Words 47 from other languages may also be included, and it is within the scope of the invention for the set of flatware 21 to include words 47 from another language spoken by the participants, for example, Spanish, French, or other languages. In addition, it will also be understood that with respect to the particular words 47 illustrated herein, their placement on particular types of utensils is not limited to the arrangement shown, so that the words 47 illustrated on the salad forks 29 can also be formed on, for example, dinner knives 33, or any other utensil, within the present invention.

The place settings 23 may be located on a dining table 25, but also may be scattered among several tables or other surfaces, or even located on the laps of the participants. In this manner, the set of flatware 21 of the present invention can be used indoors, outdoors, and in any number of environments.

The word game of the present invention is played among a group of participants seated at place settings 23 as shown, for example, in FIG. 1. The set of flatware pieces 21 of the present invention are distributed among the place settings 23 as shown in FIGS. 1 and 2, with the pieces of the set of flatware 21 within each of the utensil types, i.e., salad forks 29, dinner forks 31, dinner knives 33, etc., randomly distributed among the place settings 23. Each of the participants will then read the combination of words at his or her respective place setting, as shown for example in FIG. 2 at the place settings 23', 23". Thus, the participant at the place setting 23' would read the words 47 ALLOW, DREAM, OBSERVE, WONDER, and SEEK while the participant at the place setting 23" would read the words 47 GRACE, BEGIN, REFLECT, DANCE, and HUG. The participants would then compare the respective combination of the words 47 at the place settings 23', 23" and discuss the inspirational and other thoughts generated by these words 47.

In this way, the word game of the present invention fosters conversation, promotes uplifting and inspirational thoughts, and creates a harmonious and beneficial feeling among the participants. The atmosphere of fellowship and generosity thereby generated is beneficial for the participants, as well as others with whom they come in contact. The present invention can be used daily, to continuously inspire the users, or can be utilized at important occasions for assisting the development of conversation and good will. The set of flatware of the present invention is easily transportable, and can be used in practically any setting, whether formal or informal. It is also not necessary for a traditional dining table to be used, but the flatware set of the present invention can also be used on a picnic or at other outdoor events.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A set of flatware comprising:

a plurality of flatware pieces of a plurality of utensil types;

each said flatware piece having formed thereon a word selected from a group of a plurality of predetermined words, each of the words in the group being different; and said flatware pieces being sufficient in number to form a predetermined number of place settings at which said flatware pieces within each of said utensil types are randomly distributed for forming random combinations of said selected words at each of said place settings.

2. The set of flatware of claim 1, wherein each of said words of said group is selected to foster conversation among the users of said set of flatware.

3. The set of flatware of claim 1, wherein each of said words of said group is selected to foster inspirational thought by the user thereof.

4. The set of flatware of claim 1, wherein said utensil types include forks, spoons, and knives.

5. The set of flatware of claim 4, wherein said utensil types include salad forks, dinner forks, tea spoons, table spoons, and dinner knives.

6. A conversation stimulating set of flatware comprising:

a plurality of flatware pieces of a plurality of utensil types selected from the group consisting of forks, spoons, and knives;

each said flatware piece having formed thereon a word selected from a group of a plurality of predetermined words, each of the words in the group being different; and said set of flatware pieces being sufficient in number to form a predetermined number of place settings at which said flatware pieces within each of said utensil types are distributed for forming combinations of said words at each of said place settings.

7. The set of flatware of claim 6, wherein said combinations of said words are random.

8. A word game for play by a plurality of participants, comprising:

a predetermined number of place setting locations;

a set of flatware pieces of a plurality of utensil types, each of said pieces having formed thereon a word selected from a predetermined group of a plurality of words, each of the words in the group being different; and said set of flatware pieces being sufficient to form a place setting at each of said place setting locations with the pieces within each utensil type being distributed so as to generate random combinations of the selected words at each place setting, whereby each participant can read the combination of words at the respective place setting of the participant, and the participants can compare the combination of words at each of the place settings with the combinations of words at the other place settings.

9. A method of playing a word game among a plurality of participants, said method comprising the steps of:

providing a set of flatware pieces of a plurality of utensil types, each of the flatware pieces having formed thereon a word selected from a group of a plurality of predetermined words, each of the words in the group being different;

distributing the flatware pieces to form a plurality of place settings at which the pieces within each of the utensil types are randomly mixed, so as to generate random combinations of the selected words at each place setting;

each participant reading the random combination of words at a respective one of the place settings; and continuing play by the participants comparing the random combination of words at each of the place settings with the combinations of words at the other place settings.

10. The method for playing a word game of claim 9, further including the step of the participants discussing the combinations of words at the place settings.

* * * * *